US010215469B2

(12) United States Patent
Chae et al.

(10) Patent No.: US 10,215,469 B2
(45) Date of Patent: Feb. 26, 2019

(54) COOLING CYCLE APPARATUS FOR REFRIGERATOR

(71) Applicant: LG ELECTRONICS INC., Seoul (KR)

(72) Inventors: Sunam Chae, Seoul (KR); Kyungseok Kim, Seoul (KR); Kyunghun Cha, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 203 days.

(21) Appl. No.: 15/029,235

(22) PCT Filed: Jan. 21, 2016

(86) PCT No.: PCT/KR2016/000667
§ 371 (c)(1),
(2) Date: Apr. 13, 2016

(87) PCT Pub. No.: WO2016/117946
PCT Pub. Date: Jul. 28, 2016

(65) Prior Publication Data

US 2016/0356537 A1 Dec. 8, 2016

(30) Foreign Application Priority Data

Jan. 23, 2015 (KR) ..... 10-2015-0011348

(51) Int. Cl.
*F25B 1/00* (2006.01)
*F25D 11/02* (2006.01)
(Continued)

(52) U.S. Cl.
CPC ..... *F25D 11/022* (2013.01); *F25B 1/10* (2013.01); *F25B 5/02* (2013.01); *F25B 40/00* (2013.01);
(Continued)

(58) Field of Classification Search
CPC .. F25D 11/022; F25B 5/02; F25B 5/04; F25B 1/10; F25B 40/00; F25B 40/04;
(Continued)

(56) References Cited

U.S. PATENT DOCUMENTS

2002/0069654 A1 6/2002 Doi et al.
2006/0137386 A1* 6/2006 Itsuki ..... F25B 5/02 62/510
(Continued)

FOREIGN PATENT DOCUMENTS

EP 1 707 900 10/2006
JP H 11-063694 3/1999
JP 2003106693 * 4/2003

OTHER PUBLICATIONS

Machine Translation of JP2003106693.*
(Continued)

*Primary Examiner* — Joseph Trpisovsky
(74) *Attorney, Agent, or Firm* — Ked & Associates, LLP

(57) ABSTRACT

A cooling cycle apparatus for a refrigerator includes a first compressor, a condenser for condensing a refrigerant compressed in the first compressor, a first expansion device for lowering a temperature and a pressure of a portion of the condensed refrigerant, a first evaporator for evaporating the refrigerant, a second expansion device for lowering a temperature and a pressure of a remaining portion of the refrigerant, a gas-liquid separator for separating a liquid-phase refrigerant from a gas-phase refrigerant in the refrigerant, a third expansion device for lowering a temperature and a pressure of the liquid-phase refrigerant, a second evaporator for evaporating the refrigerant that has passed through the third expansion device, and a second compressor for compressing the refrigerant that has passed through the second evaporator and transferring the refrigerant to the first compressor, wherein the refrigerant that has passed
(Continued)

through the first evaporator and the gas-phase refrigerant separated in the gas-liquid separator are introduced into the first compressor together with the refrigerant compressed in the second compressor.

8 Claims, 6 Drawing Sheets

(51) Int. Cl.

| | |
|---|---|
| ***F25B 5/02*** | (2006.01) |
| ***F25B 1/10*** | (2006.01) |
| ***F25B 40/00*** | (2006.01) |
| ***F25B 40/04*** | (2006.01) |

(52) U.S. Cl.
CPC ..... *F25B 40/04* (2013.01); *F25B 2341/062* (2013.01); *F25B 2341/0661* (2013.01); *F25B 2341/0662* (2013.01); *F25B 2400/054* (2013.01); *F25B 2400/075* (2013.01); *F25B 2400/13* (2013.01); *F25B 2400/23* (2013.01); *F25B 2600/2509* (2013.01)

(58) Field of Classification Search
CPC ..... F25B 2341/062; F25B 2341/0661; F25B 2341/0662; F25B 2400/054; F25B 2400/075; F25B 2400/13; F25B 2400/23; F25B 2600/2509
USPC ..... 62/498, 115, 117
See application file for complete search history.

(56) References Cited

U.S. PATENT DOCUMENTS

2011/0023514 A1* 2/2011 Mitra ..... F25B 1/10 62/222
2012/0023978 A1 2/2012 Chae et al.

OTHER PUBLICATIONS

International Search Report and Written Opinion dated Apr. 13, 2016 issued in Application No. PCT/KR2016/000667.
European Search Report dated Jan. 2, 2018 issued in Application No. 16724577.8.

* cited by examiner

[Fig. 1]
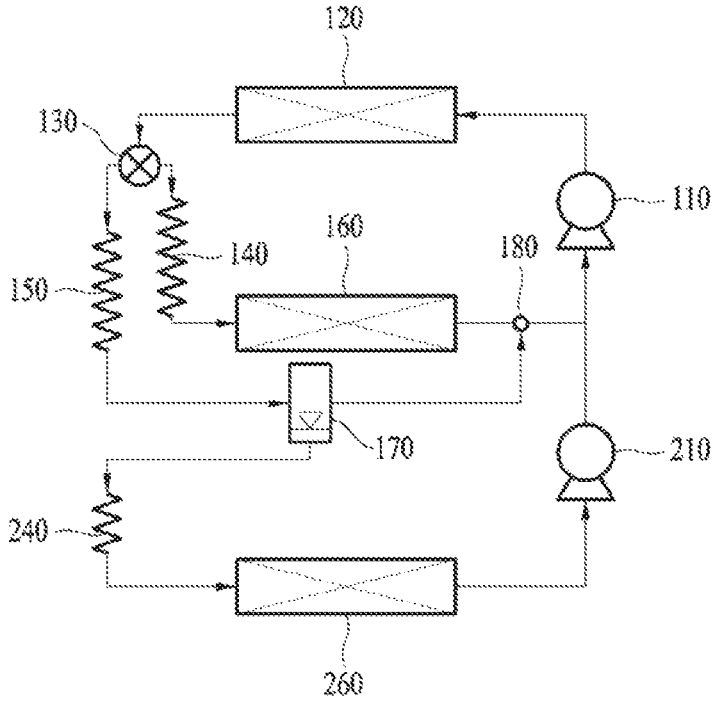
[Fig. 2]
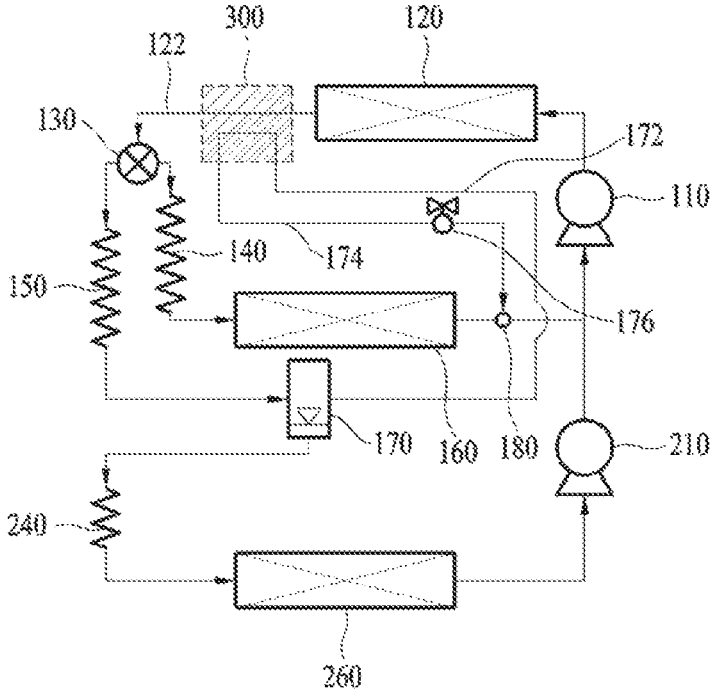

[Fig. 3]
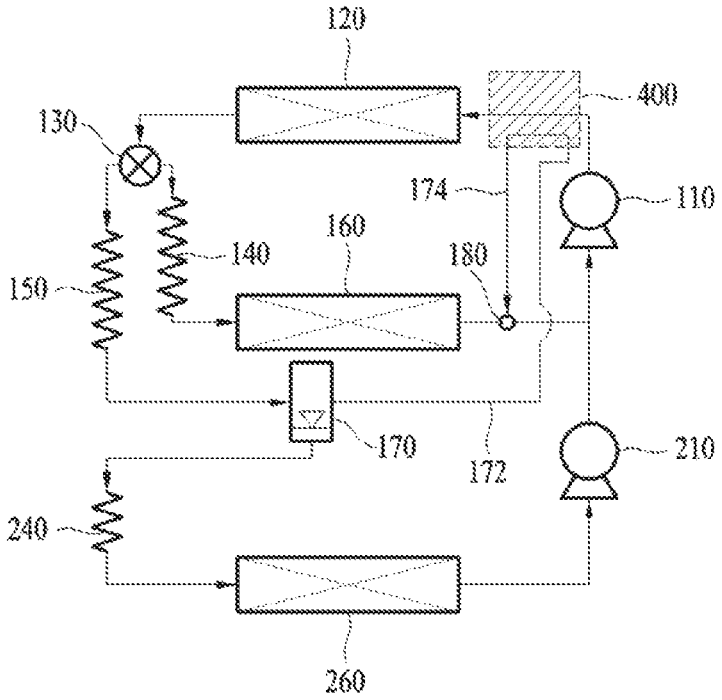
[Fig. 4]
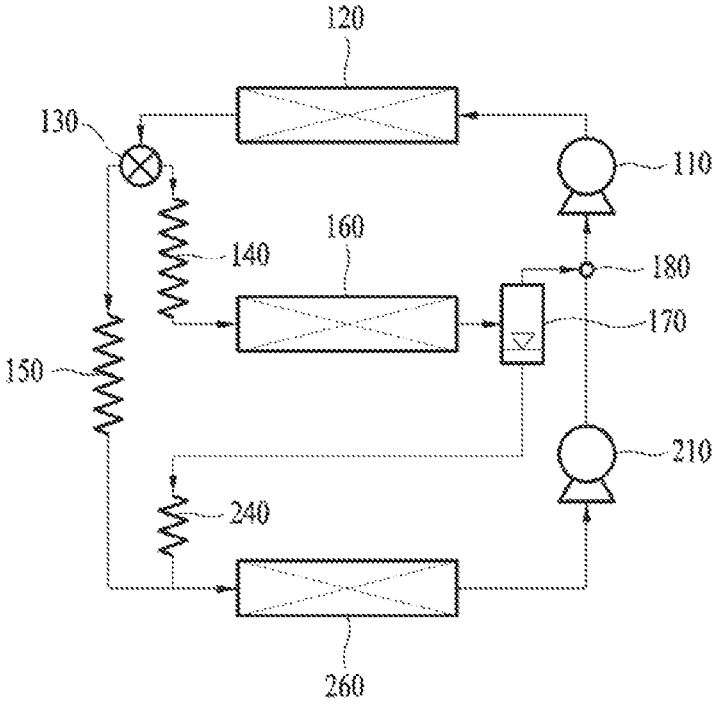

[Fig. 5]
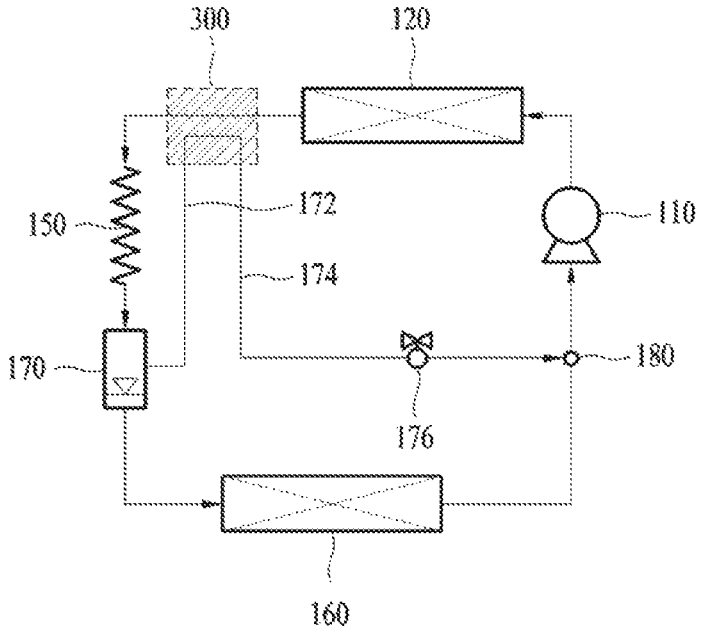
[Fig. 6]
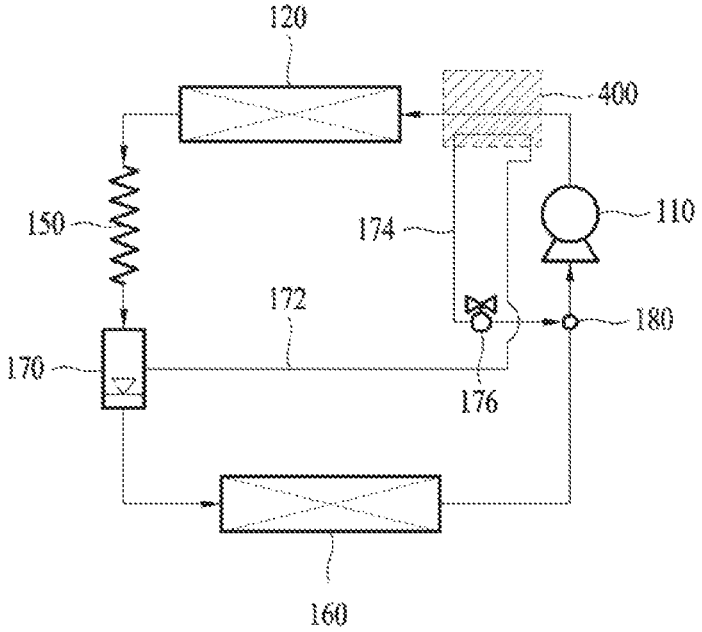

[Fig. 7]
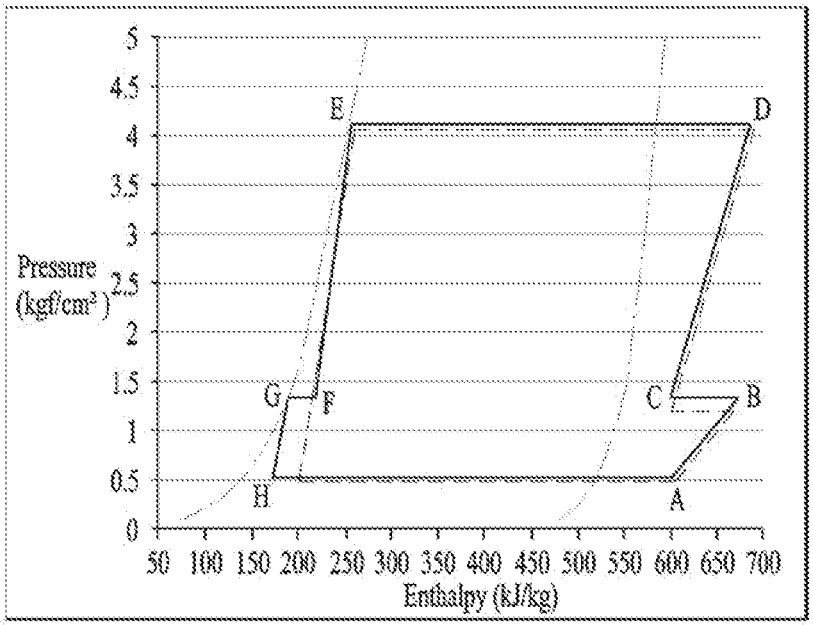
[Fig. 8]
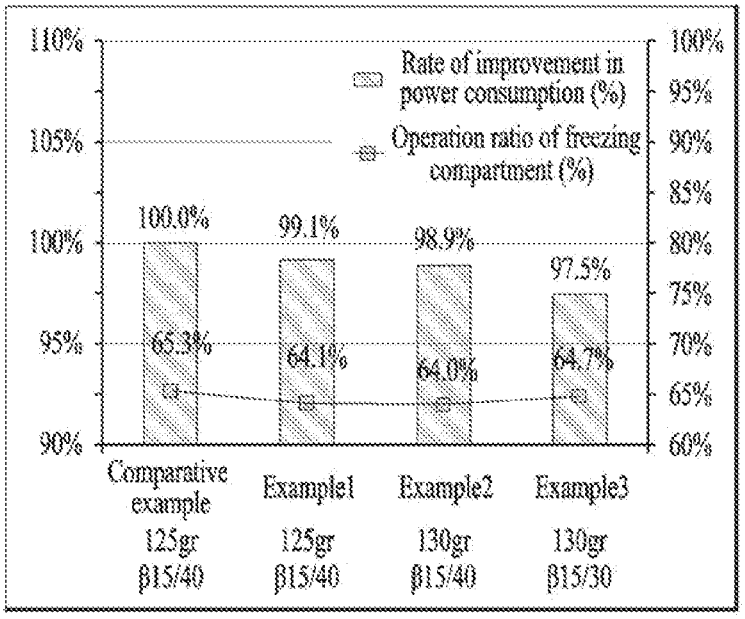

[Fig. 9]
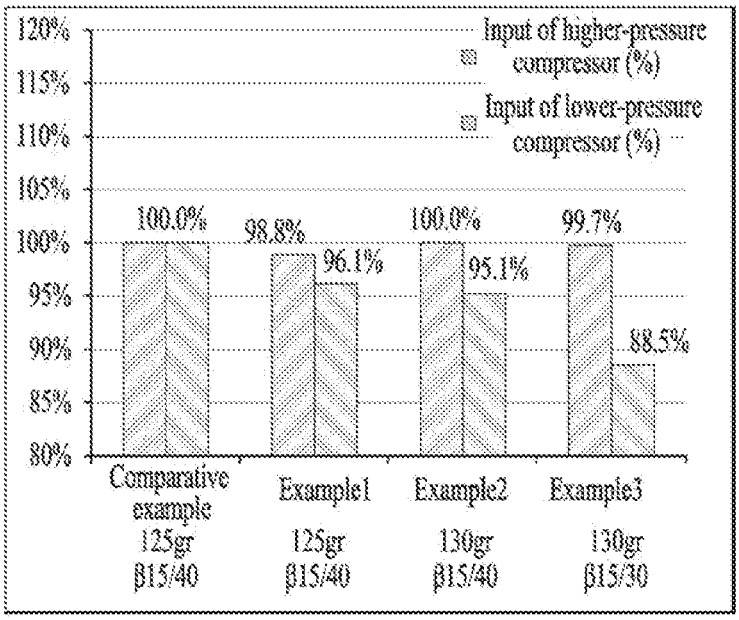
[Fig. 10]
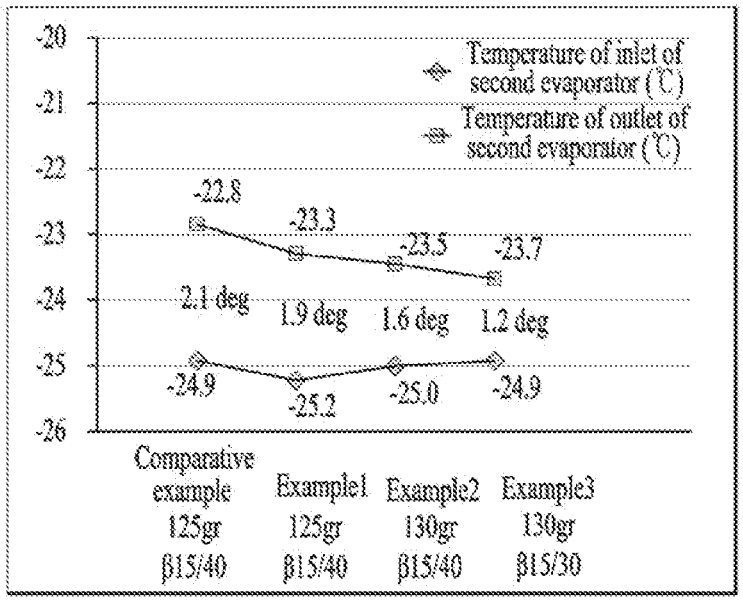

[Fig. 11]
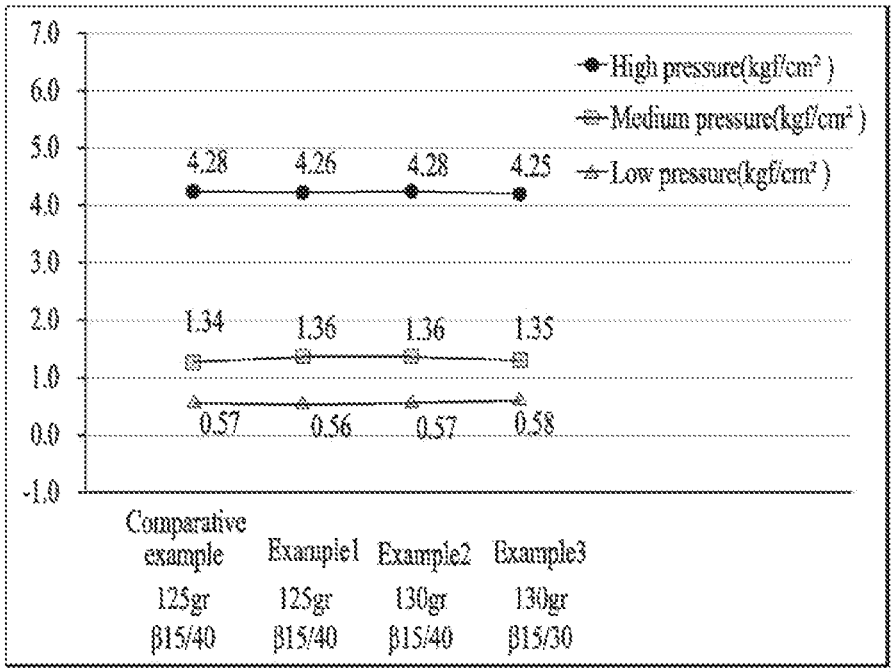

COOLING CYCLE APPARATUS FOR REFRIGERATOR

CROSS-REFERENCE TO RELATED PATENT APPLICATION

This application is a U.S. National Stage Application under 35 U.S.C. § 371 of PCT Application No. PCT/KR2016/000667, filed Jan. 21, 2016, whose entire disclosure is hereby incorporated by reference.

TECHNICAL FIELD

The present invention relates to a cooling cycle apparatus for a refrigerator, and more particularly to a cooling cycle apparatus for a refrigerator in which a gas-liquid separator is appropriately connected to the cooling cycle of the refrigerator so as to enhance the cooling efficiency thereof.

BACKGROUND ART

The term "cooling cycle" refers to a cycle of a thermodynamic process of absorbing heat from a cold mass and transferring the heat to a thermal mass. The simplest apparatus using such a cooling cycle may include a compressor, a condenser, an expansion device and an evaporator.

The compressor serves to compress a refrigerant and discharge the refrigerant in the form of high-temperature and high-pressure gas, and the condenser serves to condense the high-temperature and high-pressure refrigerant discharged from the compressor into a liquid-phase refrigerant having an intermediate or lower temperature and a high pressure.

The expansion device serves to expand the refrigerant having an intermediate or lower temperature and a high pressure, into a low-temperature and low-pressure refrigerant, and the expanded refrigerant is evaporated in the evaporator. At this time, the temperature and pressure of the refrigerant decreases further. Upon evaporation of the refrigerant, the refrigerant absorbs ambient heat, thus cooling the ambient air.

As the expansion device, a capillary tube or an expansion valve may be used.

The refrigerant, which has been circulated through one cycle, is transferred to the compressor again, and repeatedly undergoes the cyclical process. During this cycle process, the evaporator absorbs ambient heat, whereby cooled air or cold air is generated. The refrigerator transfers the cold air to a cooling compartment by means of a blower, thereby cooling the inside of the cooling compartment.

An increase in the amount of heat of the evaporator in the cooling cycle means increased cooling performance relative to the amount of work done by the compressor (coefficient of performance; COP).

However, heat loss may occur while the refrigerant is expanded in the expansion device, thereby increasing the dryness at the inlet of the evaporator. The evaporator is constructed such that a liquid-phase refrigerant absorbs heat from the ambient air while being evaporated, that is, being vaporized. The increase in the dryness of the evaporator means that an increasing proportion of the refrigerant introduced into the evaporator is gas-phase refrigerant. Here, since the gas-phase refrigerant is not evaporated in the evaporator, there is a problem in that the gas-phase refrigerant is not able to behave as a heat source for the evaporator, thereby decreasing the COP.

Therefore, there is a need to lower the dryness of the refrigerant introduced into the evaporator by separating liquid-phase refrigerant from gas-phase refrigerant in the refrigerant that has passed through the expansion device.

Although the conventional cooling cycle is provided with an accumulator, which is adapted to separate the liquid-phase refrigerant, which has still not evaporated, from the refrigerant that has passed through the evaporator, and to transfer only this gas-phase refrigerant to the compressor, there is a problem whereby the separated liquid-phase refrigerant accumulates in the accumulator and thus cannot be reused.

DISCLOSURE

Technical Problem

Therefore, the present invention has been made in view of the above problems, and it is an object of the present invention to provide a cooling cycle apparatus for a refrigerator in which a gas-liquid separator is connected to the outlet of an expansion device so as to lower the dryness of an evaporator and increase the amount of heat of the evaporator, thereby enhancing the COP of the cooling cycle and lowering power consumption.

Technical Solution

The object of the present invention can be achieved by providing a cooling cycle apparatus for a refrigerator including a first compressor for compressing a refrigerant, a condenser for condensing the refrigerant compressed in the first compressor, a first expansion device for lowering the temperature and pressure of a portion of the refrigerant condensed in the condenser, a first evaporator for evaporating the refrigerant that has passed through the first expansion device, a second expansion device for lowering the temperature and pressure of a remaining portion of the refrigerant condensed in the condenser, a gas-liquid separator for separating a liquid-phase refrigerant from gas-phase refrigerant in the refrigerant that has passed through the second expansion device, a third expansion device for lowering the temperature and pressure of the liquid-phase refrigerant that was separated in the gas-liquid separator, a second evaporator for evaporating the refrigerant that has passed through the third expansion device, and a second compressor for compressing the refrigerant that has passed through the second evaporator and transferring the refrigerant to the first compressor, wherein the refrigerant that has passed through the first evaporator and the gas-phase refrigerant that was separated in the gas-liquid separator are introduced into the first compressor together with the refrigerant compressed in the second compressor.

The first compressor may compress the refrigerant at a higher pressure than the second compressor.

The third expansion device may be shorter than the second expansion device.

Cold air generated in the first evaporator may be supplied to a refrigerating compartment, and cold air generated in the second evaporator may be supplied to a freezing compartment.

The cooling cycle apparatus may further include a heat exchanging unit, which is provided downstream of the condenser so as to exchange heat between the gas-phase refrigerant that has passed through the gas-liquid separator and the refrigerant that was condensed in the condenser.

The cooling cycle apparatus may further include a control valve, which is provided on a flow channel, which extends from the gas-liquid separator to a downstream flow channel of the first evaporator through the heat exchanging unit and through which the gas-phase refrigerant separated in the gas-liquid separator flows, so as to control an opening degree of the flow channel.

The cooling cycle apparatus may further include a heat exchanging unit, which is provided downstream of the first compressor so as to enable heat exchange between the gas-phase refrigerant that has passed through the gas-liquid separator and the refrigerant that has been compressed in the first compressor.

The heat exchanging unit may lower the pressure of the refrigerant compressed in the first compressor.

In another aspect of the present invention, provided herein is a cooling cycle apparatus for a refrigerator, including a first compressor for compressing a refrigerant, a condenser for condensing the refrigerant compressed in the first compressor, a first expansion device for lowering the temperature and pressure of a portion of the refrigerant condensed in the condenser, a first evaporator for evaporating the refrigerant that has passed through the first expansion device, a second expansion device for lowering the temperature and pressure of a remaining portion of the refrigerant condensed in the condenser, a gas-liquid separator for separating a liquid-phase refrigerant from gas-phase refrigerant in the refrigerant that has passed through the first evaporator, a third expansion device for lowering the temperature and pressure of the liquid-phase refrigerant separated in the gas-liquid separator, a second evaporator for evaporating the refrigerant that has passed through the second expansion device and the refrigerant that has passed through the third expansion device, and a second compressor for compressing the refrigerant that has passed through the second evaporator and transferring the refrigerant to the first compressor, wherein the gas-phase refrigerant separated in the gas-liquid separator is introduced into the first compressor together with the refrigerant compressed in the second compressor.

The first compressor may compress the refrigerant at a higher pressure than the second compressor.

The third expansion device may be shorter than the second expansion device.

Cold air generated in the first evaporator may be supplied to a refrigerating compartment, and cold air generated in the second evaporator may be supplied to a freezing compartment.

In still another aspect of the present invention, provided herein is a cooling cycle apparatus for a refrigerator, including a compressor for compressing a refrigerant, a condenser for condensing the refrigerant compressed in the compressor, an expansion device for lowering the temperature and pressure of the refrigerant condensed in the condenser, a gas-liquid separator for separating liquid-phase refrigerant from gas-phase refrigerant in the refrigerant that has passed through the expansion device, a second evaporator for evaporating the liquid-phase refrigerant that was separated in the gas-liquid separator, and a heat exchanging unit for enabling heat exchange between the gas-phase refrigerant that was separated in the gas-liquid separator and the liquid-phase refrigerant condensed in the condenser and transferring the gas-phase refrigerant to the compressor.

The cooling cycle apparatus may further include a control valve, which is provided on a flow channel, which extends from the gas-liquid separator to a flow channel located upstream of the compressor through the heat exchanging unit and through which the gas-phase refrigerant, which was separated in the gas-liquid separator, flows, so as to control an opening degree of the flow channel.

In yet another aspect of the present invention, provided herein is a cooling cycle apparatus for a refrigerator, including a compressor for compressing a refrigerant, a condenser for condensing the refrigerant compressed in the compressor, an expansion device for lowering the temperature and pressure of the refrigerant condensed in the condenser, a gas-liquid separator for separating liquid-phase refrigerant from gas-phase refrigerant in the refrigerant that has passed through the expansion device, a second evaporator for evaporating the liquid-phase refrigerant separated in the gas-liquid separator, and a heat exchanging unit for enabling heat exchange between the gas-phase refrigerant separated in the gas-liquid separator and the refrigerant compressed in the compressor and transferring the gas-phase refrigerant to the compressor.

The cooling cycle apparatus may further include a control valve, which is provided on a flow channel, which extends from the gas-liquid separator to a flow channel located upstream of the compressor through the heat exchanging unit and through which the gas-phase refrigerant, which was separated in the gas-liquid separator, flows, so as to control an opening degree of the flow channel.

Advantageous Effects

According to the cooling cycle apparatus for a refrigerator according to the present invention, as described above, there is an effect of lowering the dryness of the evaporator and increasing the amount of heat of the evaporator by separating a gas-phase refrigerant from the refrigerant that has passed through the expansion device and transferring the refrigerant to the evaporator.

Furthermore, it is possible to lower the work of the compressor and enhance the efficiency of the cooling system by lowering the amount of the gas-phase refrigerant introduced into the evaporator.

In addition, by transferring the gas-phase refrigerant separated in the gas-liquid separator to the compressor again and compressing the refrigerant, the liquid-phase refrigerant is evaporated in the evaporator and is introduced into the compressor, and the gas-phase refrigerant separated in the gas-liquid separator is introduced into the compressor again and is compressed together with the gas-phase refrigerant, thereby enabling all of the refrigerant to be circulated and used in the cooling cycle apparatus.

Furthermore, prior to being introduced into the compressor, the gas-phase refrigerant separated in the gas-liquid separator exchanges heat with the refrigerant condensed in the condenser so as to increase the amount of condensation heat, or exchanges heat with the refrigerant compressed in the compressor so as to lower the discharge pressure of the compressor, thereby enhancing the efficiency of the refrigerating system.

DESCRIPTION OF DRAWINGS

The accompanying drawings, which are included to provide a further understanding of the invention, illustrate embodiments of the invention and together with the description serve to explain the principle of the invention.

In the drawings:

FIG. 1 is a view showing a cooling cycle apparatus according to a first embodiment of the present invention;

FIG. 2 is a view showing a cooling cycle apparatus according to a second embodiment of the present invention;

FIG. 3 is a view showing a cooling cycle apparatus according to a third embodiment of the present invention;

FIG. 4 is a view showing a cooling cycle apparatus according to a fourth embodiment of the present invention;

FIG. 5 is a view showing a cooling cycle apparatus according to a fifth embodiment of the present invention;

FIG. 6 is a view showing a cooling cycle apparatus according to a sixth embodiment of the present invention;

FIG. 7 is a graph illustrating a P-H (pressure-enthalpy) diagram of the cooling cycle apparatus according to the first embodiment of the present invention;

FIG. 8 is a graph illustrating the rate of improvement in power consumption and the operation ratio of the freezing compartment by the cooling cycle apparatus according to the first embodiment of the present invention;

FIG. 9 is a graph illustrating inputs of two compressors of the cooling cycle apparatus according to the first embodiment of the present invention;

FIG. 10 is a graph illustrating the temperatures of the inlet and outlet of the second evaporator of the cooling cycle apparatus according to the first embodiment of the present invention; and FIG. 11 is a graph illustrating pressure variation at higher pressure, medium pressure and lower pressure in the cooling cycle.

BEST MODE

Reference will now be made in detail to the preferred embodiments of the present invention, examples of which are illustrated in the accompanying drawings.

FIG. 1 is a view showing a cooling cycle apparatus according to a first embodiment of the present invention.

Like a typical cooling cycle apparatus, the cooling cycle apparatus according to the first embodiment of the present invention includes compressors, a condenser, expansion devices and evaporators. Refrigerant is doubly compressed by two compressors 110 and 210. Even in the case where there is only one condenser 120, the evaporators include a first evaporator 160 and a second evaporator 260 such that cold air generated in the respective evaporator is respectively blown to a refrigerating compartment and a freezing compartment.

The high-temperature and high-pressure gas-phase refrigerant compressed in the first compressor 110 is condensed while passing through the condenser 120.

The refrigerant condensed in the condenser 120 is diverged at a connector 130 into two refrigerant portions, one portion of which is transferred to the first expansion device 140 and the other portion of which is transferred to the second expansion device 150.

The refrigerant that has passed through the first expansion device 140 is transferred to the first evaporator 160. The refrigerant is evaporated at the first evaporator 160, and is introduced back into the first compressor 110 to thus be circulated.

The refrigerant that has passed through the second expansion device 150 is introduced into a gas-liquid separator 170 where the refrigerant is divided into a liquid-phase refrigerant and gas-phase refrigerant.

The liquid-phase refrigerant separated in the gas-liquid separator 170 is expanded again while passing through the third expansion device 240.

The low-temperature and low-pressure refrigerant expanded at the third expansion device 240 is introduced into the second evaporator 260, in which the refrigerant exchanges heat with ambient air while being evaporated.

The refrigerant that has passed through the second evaporator 260 is introduced into the second compressor 210, and is firstly compressed therein. The refrigerant is then introduced into the first compressor 110, and is secondly compressed therein.

The refrigerant that has passed through the first evaporator 160 and the gas-phase refrigerant separated in the gas-liquid separator 170 are mixed with the refrigerant that has been compressed in the second compressor 210, and the mixed refrigerant is introduced into the first compressor 110.

The refrigerant that has passed through the first evaporator 160 and the gas-phase refrigerant separated in the gas-liquid separator 170 are mixed with each other at a connecting portion, which is denoted by reference numeral "180", by the connection of the associated refrigerant pipes.

The first compressor 110 preferably compresses the refrigerant at a higher pressure than the second compressor 210.

The first compressor 110 and the second compressor 210 are connected to each other in series. The second compressor 210 serves as the lower-pressure compressor, and the first compressor 110 serves as the higher-pressure compressor.

In the cooling cycle apparatus according to the present invention, the refrigerant may pass through only the first compressor 110 or both the first compressor 110 and the second compressor 210. Naturally, the latter case will achieve higher freezing performance.

The third expansion device 240 is preferably shorter than the second expansion device 150.

The expansion devices may be constituted by capillary tubes or expansion valves. The longer the expansion device, the more the refrigerant is expanded and the greater the decrease in the pressure of the refrigerant.

Owing to the first pressure lowering in the second expansion device 150, the refrigerant is further expanded. At this time, some of the expanded refrigerant may evaporate, thereby generating gas-phase refrigerant. Accordingly, the gas-phase refrigerant is separated in the gas-liquid separator 170, and only the liquid-phase refrigerant is transferred to the third expansion device 240.

Although the refrigerant that has passed through the third expansion device 240 may also contain a small amount of gas-phase refrigerant, since the third expansion device 240 is shorter than the second expansion device 150, the proportion of gas-phase refrigerant in the refrigerant introduced into the second evaporator may be much lower than otherwise.

The first expansion device 140 may be longer or shorter than the second expansion device 150, or may be approximately the same length as the second expansion device 150.

The gas-liquid separator 170 may adopt any of a type using surface tension and a difference in density and a type using centrifugal force and a difference in density.

The gas-liquid separator that uses surface tension and a difference in density separates liquid-phase refrigerant from gas-phase refrigerant by employing the tendency for liquid-phase refrigerant to adhere to the surfaces of grooves formed in the inner surface of the gas-liquid separator, and causes the liquid-phase refrigerant to move downward and the gas-phase refrigerant to move upward due to the difference in density.

The gas-liquid separator that uses centrifugal force and a difference in density separates liquid-phase refrigerant from gas-phase refrigerant by rotating the cylindrical gas-liquid separator while refrigerant is being introduced into the gas-liquid separator so as to cause liquid-phase refrigerant to be separated from gas-phase refrigerant and to move downward and to cause gas-phase refrigerant to move upward.

It is preferable that the cold air generated in the first evaporator 160 be supplied to the refrigerating compartment and that the cold air generated in the second evaporator 260 be supplied to the freezing compartment.

The refrigerant that has passed through the first evaporator 160 is compressed only by the first compressor 110, and is expanded only by the first expansion device 140.

Meanwhile, the refrigerant that has passed through the second evaporator 260 is dually compressed by the second compressor 210 and the first compressor 110, and is dually expanded while passing through the second expansion device 150 and the third expansion device 240. Consequently, the cold air generated in the second evaporator 260 will have a lower temperature than the cold air generated in the first evaporator 160.

Accordingly, the cold air generated in the first evaporator 160 may be supplied to the refrigerating compartment which is typically maintained at a temperature above zero, and the cold air generated in the second evaporator 260 may be supplied to the freezing compartment which is maintained at a temperature below zero.

The cold air generated in the respective evaporators may be respectively supplied to the refrigerating compartment and the freezing compartment through flow channels, which are provided in the refrigerator and are provided with respective blowers.

Consequently, it is possible to concurrently cool both the refrigerating compartment and the freezing compartment by operating the two compressors concurrently.

Owing to the cooling cycle apparatus according to the first embodiment, in a refrigeration system in which refrigerant is dually compressed by two compressors, which are connected to each other in series, it is possible to lower the amount of heat of the second evaporator by lowering the dryness of the refrigerant introduced into the second evaporator, and it is possible to enhance the COP of the refrigerating system by lowering the amount of work performed by the lower-pressure compressor.

FIG. 2 is a view showing a cooling cycle apparatus according to a second embodiment of the present invention.

The cooling cycle apparatus according to the second embodiment differs from the cooling cycle apparatus according to the first embodiment in that the second embodiment further includes a heat exchanging unit 300 provided downstream of the condenser 120 so as to enable heat exchange between the gas-phase refrigerant that has passed through the gas-liquid separator 170 and the refrigerant in a flow channel 122 that was condensed in the condenser 120.

The gas-phase refrigerant, which has passed through the second expansion device 150 and has been separated at the gas-liquid separator 170, is a low-temperature and low-pressure gas-phase refrigerant, and exchanges heat with the liquid-phase refrigerant having a intermediate temperature or low temperature and a high pressure, which has been condensed in the condenser 120.

In other words, the refrigerant, which has been condensed in the condenser 120, is further condensed in the heat exchanging unit 300, thereby improving the efficiency of the refrigerating system.

A flow channel 172 connected to an outlet of the gas-liquid separator 170 extends through the heat exchanging unit 300 and is connected to a flow channel 174 connected to the connecting portion 180 provided in a downstream flow channel that is located downstream of the first evaporator 160.

The flow channel 174 is preferably provided with a control valve 176 for controlling the opening degree of the flow channel.

Although only the gas-phase refrigerant is introduced into the first compressor 110 by the gas-liquid separator 170, the gas-phase refrigerant may contain a small amount of liquid-phase refrigerant, even after the gas-liquid separation.

The control valve 176 is able to minimize the amount of the liquid-phase refrigerant that is introduced into the first compressor 110 by controlling the opening degree of the flow channel 174, thus imposing pressure resistance on the inside of the flow channel.

FIG. 3 is a view showing a cooling cycle apparatus according to a third embodiment of the present invention.

The cooling cycle apparatus according to the third embodiment differs from the cooling cycle apparatus according to the second embodiment in that the heat exchanging unit is not positioned downstream of the evaporator 120 but is positioned between the first compressor 110 and the condenser 120.

The heat exchanging unit 400 disposed downstream of the first compressor 110 exchanges heat between the gas-phase refrigerant that has passed through the gas-liquid separator 160 and the refrigerant that was compressed in the first compressor 110.

To this end, a refrigerant flow channel 172, into which the gas-phase refrigerant is introduced from the gas-liquid separator 170, is positioned close to the flow channel between the first compressor 110 and the condenser 120 such that heat exchange between the two refrigerant pipes is implemented. The refrigerant flow channel 172, which extends through the heat exchanging unit 400, is connected to a flow channel 174, which is in turn connected to the connecting portion 180, which is provided in a downstream flow channel that is located downstream of the first evaporator 160.

Owing to the cooling cycle apparatus according to the third embodiment, it is possible to improve the efficiency of the refrigerating system by lowering the pressure of the refrigerant that is discharged from the first compressor 110, while the refrigerant passes through the heat exchanging unit 400.

FIG. 4 is a view showing a cooling cycle apparatus according to a fourth embodiment of the present invention.

The cooling cycle apparatus according to the fourth embodiment differs from the cooling cycle apparatus according to the first embodiment in that the gas-liquid separator 170 is not connected at a location downstream of the second expansion device 150, but is connected at a location downstream of the first evaporator 160.

Specifically, the gas-liquid separator 170 separates liquid-phase refrigerant from gas-phase refrigerant in the refrigerant, which has been expanded in the first expansion device 140 and evaporated in the first evaporator 160, such that the gas-phase refrigerant is introduced into the first compressor 110 through the flow channel connected to the connecting portion 180 and the liquid-phase refrigerant is expanded again in the third expansion device 240 and is then introduced into the second evaporator 260.

The refrigerant expanded in the second expansion device 150 is introduced into the second evaporator 260 together with the liquid-phase refrigerant, which is separated at the gas-liquid separator 170 and is expanded while passing through the third expansion device 240.

Like the previous embodiments, it is preferable for the first compressor 110 to compress the refrigerant at a higher pressure than the second compressor 210 and for the third expansion device 240 to be shorter than the second expansion device 150.

It is preferable that the cold air generated in the first evaporator 160 be supplied to the refrigerating compartment and that the cold air generated in the second evaporator 260 be supplied to the freezing compartment.

In the cooling cycle apparatus according to the fourth embodiment, since there is no overcooling of a suction pipe due to overcharging of refrigerant in the first evaporator 160, the first evaporator 160 may be used as an evaporator for a refrigerating compartment that is not provided with an accumulator.

Refrigerant is charged in the first evaporator 160 in a slightly overcooled state. The proportion of the refrigerant that is in a liquid phase may be increased at the rear end of the first evaporator 160 by the gas-liquid separator 170, and the refrigerant may be introduced into the second evaporator 260 through the third expansion device 240 where the refrigerant is evaporated.

Since the refrigerating compartment and the freezing compartment may be concurrently cooled, and the first evaporator 160 and the second evaporator 260 are connected to teach other in series, it is naturally possible to solve the conventional problem, that is, concentration of refrigerant that may occur between two evaporators connected to each other in parallel.

FIG. 5 is a view showing a cooling cycle apparatus according to a fifth embodiment of the present invention.

The cooling cycle apparatus according to the fifth embodiment includes only one compressor 110 and only one evaporator 160.

The refrigerant compressed in the compressor 110 is condensed in the condenser 120, and is expanded in the expansion device 150, whereby the temperature and pressure of the refrigerant are decreased.

The refrigerant expanded in the expansion device 150 is introduced into the gas-liquid separator 170, where the gas-phase refrigerant is separated from the liquid-phase refrigerant.

The separated liquid-phase refrigerant is introduced into the evaporator 160. The liquid-phase refrigerant cools the ambient air while being evaporated in the evaporator 160, and is introduced into the compressor 110 for circulation.

The separated gas-phase refrigerant exchanges heat with the refrigerant, which was condensed in the condenser 120 at the heat exchanging unit 300, which is disposed downstream of the condenser 120.

The flow channel, which is connected to the outlet of the gas-liquid separator 170 and through which the gas-phase refrigerant flows, extends downstream of the condenser 120, and is connected to the flow channel 174. The flow channel 174 is connected to the connecting portion 180, which is provided on the flow channel connected to the inlet of the compressor 110.

The gas-phase refrigerant separated in the gas-liquid separator 170 flows through the flow channel 174 connected to the inlet of the compressor 110. The flow channel 174 is preferably provided with a control valve 176 for controlling the opening degree of the flow channel.

The control valve 176 is able to minimize the amount of liquid-phase refrigerant that is contained in the separated gas-phase refrigerant and is introduced into the compressor 110 by controlling the opening degree of the flow channel 174, thus imposing a pressure resistance on the inside of the flow channel.

Owing to the cooling cycle apparatus according to the fifth embodiment of the present invention, the refrigerant condensed in the condenser 120 is further condensed in the heat exchanging unit 300, thereby improving the efficiency of the refrigerating system.

FIG. 6 is a view showing a cooling cycle apparatus according to a sixth embodiment of the present invention.

Although the cooling cycle apparatus according to the sixth embodiment includes only one compressor 110 and only one evaporator 160, as in the fifth embodiment, the cooling cycle apparatus according to the sixth embodiment differs from the cooling cycle apparatus according to the fifth embodiment in that the heat exchanging unit 400 is not disposed downstream of the condenser 120 but is disposed between the compressor 110 and the condenser 120.

The refrigerant, compressed in the compressor 110, is condensed in the condenser 120 and expanded in the expansion device 150. Subsequently, the refrigerant is divided into gas-phase refrigerant and liquid-phase refrigerant in the gas-liquid separator 170.

The separated gas-phase refrigerant exchanges heat with the refrigerant, which was compressed in the compressor 110, in the heat exchanging unit 400, which is disposed downstream of the compressor 110.

The flow channel, which is connected to the outlet of the gas-liquid separator 170 and through which the gas-phase refrigerant flows, extends downstream of the compressor 110 and is connected to the flow channel 174. The flow channel 174 is connected to the connecting portion 180, which is provided in the flow channel connected to the inlet of the compressor 110.

The gas-phase refrigerant separated in the gas-liquid separator 170 flows through the flow channel 174, which extends through the heat exchanging unit 400 and is connected to the inlet of the compressor 110. The flow channel 174 is preferably provided with a control valve 176 for controlling the opening degree of the flow channel.

The control valve 176 is able to minimize the amount of liquid-phase refrigerant that is contained in the separated gas-phase refrigerant and is introduced into the compressor 110 by controlling the opening degree of the flow channel 174, thus imposing a pressure resistance on the inside of the flow channel.

Owing to the cooling cycle apparatus according to the sixth embodiment of the present invention, the refrigerant discharged from the compressor 110 is lowered in pressure while passing through the heat exchanging unit 400, thereby improving the efficiency of the refrigerating system.

FIG. 7 is a graph illustrating a P-H (pressure-enthalpy) diagram of refrigerant circulated through the second evaporator 260, which is the evaporator for the freezing compartment in the cooling cycle apparatus according to the first embodiment of the present invention.

In the graph, the solid line indicates the P-H diagram of the cooling cycle apparatus according to the present invention, and the dotted line indicates the P-H diagram of a conventional two-stage compression cooling cycle apparatus having no gas-liquid separator.

Segment A-B indicates a procedure in which refrigerant is converted into a high-pressure gas-phase refrigerant by being compressed in the second compressor 210, which is the lower-pressure compressor.

Since only the gas-phase refrigerant separated in the gas-liquid separator 170 passes through the third expansion device 240 and the second evaporator 260 and is then introduced into the second compressor 210, it will be appreciated that the work of the second compressor 210 is lowered and thus the increase in pressure achieved by the compressor is higher than that of a conventional cooling cycle apparatus.

In segment B-C, since the refrigerant compressed in the second compressor 210 is introduced into the first compressor 110, together with the refrigerant that has passed through the first evaporator 160 and the gas-phase refrigerant separated in the gas-liquid separator 170, enthalpy decreases as the refrigerant compressed in the second compressor 210 is condensed.

Segment C-D indicates a procedure in which the merged refrigerant is compressed under high pressure by the first compressor 110.

Segment E-F indicates a procedure in which a portion of the refrigerant condensed in the condenser 120 is expanded in the second expansion device 150. It will be appreciated that the pressure of the refrigerant is significantly lowered and the enthalpy slightly decreases.

Segment F-G indicates a procedure in which only the liquid-phase refrigerant separated in the gas-liquid separator 170 is introduced into the second evaporator 260. Since only the liquid-phase refrigerant is introduced into the second evaporator 260, it will be appreciated that enthalpy slightly decreases compared to the case of refrigerant comprising both gas-phase refrigerant and liquid-phase refrigerant.

Since the enthalpy decreases due to the increased proportion of the liquid-phase refrigerant, the amount of heat that is subsequently exchanged in the evaporator can be increased compared to the conventional apparatus.

Segment G-H indicates a procedure in which the liquid-phase refrigerant separated in the gas-liquid separator 170 is secondly expanded in the third expansion device 240.

Since the third expansion device 240 is shorter than the second expansion device 150, it will be appreciated that the decrease in pressure at the time of the first expansion by the second expansion device 150 is much greater than the decrease in pressure at the time of the second expansion by the second expansion device 150.

Segment H-A indicates a procedure in which the refrigerant expanded in the third expansion device 240 is evaporated in the second evaporator 260.

Since only the liquid-phase refrigerant separated in the gas-liquid separator 170 is introduced into the second evaporator 260, it will be appreciated that the increase in enthalpy of the refrigerant owing to its passage through the second evaporator 260 is greater than that in the conventional apparatus.

As described above, by the cooling cycle apparatus according to the present invention, the amount of work that must be done by the lower-pressure compressor is lowered, and the amount of heat exchanged in the evaporator is increased by lowering the dryness of the refrigerant introduced into the evaporator, thereby enhancing the COP of the refrigerating system and lowering power consumption.

FIG. 8 is a graph illustrating the rate of improvement in power consumption and the operation ratio of the freezing compartment of the cooling cycle apparatus according to the first embodiment of the present invention.

The comparative example indicates a conventional two-stage compression cooling cycle apparatus, and examples indicate the cooling cycle apparatus according to the first embodiment of the present invention, equipped with the gas-liquid separator, the amount of refrigerant (gr) and cooling capacity of which are variously changed.

It will be appreciated that, by virtue of the provision of the gas-liquid separator, the operation ratio of the freezing compartment is decreased by 0.6-1.3%, and power consumption is decreased by 0.9-2.5%, compared to the conventional apparatus.

FIG. 9 is a graph illustrating the inputs of two compressors of the cooling cycle apparatus according to the first embodiment of the present invention.

In the cooling cycle apparatus according to the present invention, which is provided with the gas-liquid separator, it will be appreciated that, although the input of the higher-pressure compressor is not substantially different from that of the conventional apparatus, the input of the lower-pressure compressor is decreased by 3.9-11.5%.

FIG. 10 is a graph illustrating the temperatures of the inlet and outlet of the second evaporator of the cooling cycle apparatus according to the first embodiment of the present invention.

It will be appreciated that, by virtue of the provision of the gas-liquid separator, the difference between the inlet and outlet of the evaporator for the freezing compartment is 2.1 degrees in the case of the conventional apparatus but is decreased to 1.9-1.2 degrees in the case of the present invention.

FIG. 11 is a graph illustrating pressure variation at higher pressure, medium pressure and lower pressure in the cooling cycle.

Here, the lower pressure signifies the minimum pressure before the compression of refrigerant, the medium pressure signifies the pressure of the refrigerant which is firstly compressed in the lower-pressure compressor, and the higher pressure signifies the pressure of the refrigerant which is secondly compressed in the higher-pressure compressor.

It will be appreciated that, even though the gas-liquid separator is provided, the variation in pressure of refrigerant in the cooling cycle apparatus according to the present invention is almost the same as that in the conventional apparatus.

MODE FOR INVENTION

Various embodiments have been described in the best mode for carrying out the invention.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A cooling cycle apparatus for a refrigerator, comprising:

a first compressor that compresses a refrigerant;

a condenser that condenses the refrigerant compressed in the first compressor;

a first expansion device that lowers a temperature and a pressure of a portion of the refrigerant condensed in the condenser;

a first evaporator that evaporates the refrigerant that has passed through the first expansion device;

a second expansion device that lowers a temperature and a pressure of a remaining portion of the refrigerant condensed in the condenser;

a gas-liquid separator that separates a liquid-phase refrigerant from a gas-phase refrigerant in the refrigerant that has passed through the second expansion device;

a third expansion device that lowers a temperature and a pressure of the liquid-phase refrigerant separated in the gas-liquid separator;

a second evaporator that evaporates the refrigerant that has passed through the third expansion device; and a second compressor that compresses the refrigerant that has passed through the second evaporator and that transfers the refrigerant to the first compressor, wherein the refrigerant that has passed through the first evaporator and the gas-phase refrigerant separated in the gas-liquid separator are introduced into the first compressor and are prevented from flowing into the second compressor, wherein each of the first expansion device, the second expansion device and the third expansion device includes at least one of a capillary tube or an expansion valve, and wherein the refrigerant that has passed through the second evaporator is provided to pass through the second compressor, and then is introduced into the first compressor.

2. The cooling cycle apparatus according to claim 1, wherein the first compressor compresses the refrigerant at a higher pressure than the second compressor.

3. The cooling cycle apparatus according to claim 1, wherein the third expansion device is shorter than the second expansion device.

4. The cooling cycle apparatus according to claim 1, wherein cold air generated in the first evaporator is supplied to a refrigerating compartment, and cold air generated in the second evaporator is supplied to a freezing compartment.

5. The cooling cycle apparatus according to claim 1, wherein a first flow channel, which is provided downstream of the condenser and a second flow channel, which is provided downstream of the gas-liquid separator, exchange heat between the gas-phase refrigerant that has passed through the gas-liquid separator and the refrigerant condensed in the condenser.

6. The cooling cycle apparatus according to claim 5, further comprising a control valve, which is provided on the second flow channel, which extends from the gas-liquid separator to a downstream flow channel of the first evaporator and through which the gas-phase refrigerant separated in the gas-liquid separator flows, so as to control an opening degree of the second flow channel.

7. The cooling cycle apparatus according to claim 1, wherein a first flow channel, which is provided downstream of the first compressor, and a second flow channel, which is provided downstream of the gas-liquid separator, exchange heat between the gas-phase refrigerant that has passed through the gas-liquid separator and the refrigerant compressed in the first compressor.

8. The cooling cycle apparatus according to claim 7, wherein the heat exchange between the first flow channel and the second flow channel lowers a pressure of the refrigerant compressed in the first compressor.

* * * * *